US010845171B2

(12) United States Patent
Rogers

(10) Patent No.: US 10,845,171 B2
(45) Date of Patent: Nov. 24, 2020

(54) PREDICTABLY FRAGMENTING PROJECTILES HAVING INTERNALLY-ARRANGED GEOMETRIC FEATURES

(71) Applicant: G2 Research Inc., Winder, GA (US)

(72) Inventor: John Doyle Rogers, Jefferson, GA (US)

(73) Assignee: G2 Research Inc., Winder, GA (US)

( * ) Notice: Subject to any disclaimer, the term of this patent is extended or adjusted under 35 U.S.C. 154(b) by 0 days.

(21) Appl. No.: 16/881,177

(22) Filed: May 22, 2020

(65) Prior Publication Data

US 2020/0284565 A1 Sep. 10, 2020

Related U.S. Application Data

(63) Continuation of application No. 15/292,542, filed on Oct. 13, 2016, now Pat. No. 10,663,271.

(51) Int. Cl.

| | |
|---|---|
| ***F42B 12/34*** | (2006.01) |
| ***F42B 12/36*** | (2006.01) |
| ***F42B 33/00*** | (2006.01) |
| ***F42B 12/74*** | (2006.01) |

(52) U.S. Cl.

CPC ..... *F42B 12/367* (2013.01); *F42B 12/34* (2013.01); *F42B 12/74* (2013.01); *F42B 33/00* (2013.01); *F42B 33/001* (2013.01)

(58) Field of Classification Search

CPC ..... F42B 12/34; F42B 12/74; F42B 12/75

See application file for complete search history.

(56) References Cited

U.S. PATENT DOCUMENTS

| | | | |
|---|---|---|---|
| 3,003,420 | A | 10/1961 | Nosler |
| 4,048,922 | A | 9/1977 | Buljovcic |
| 4,128,059 | A | 12/1978 | Black |
| 4,550,662 | A | 11/1985 | Burczynski |
| 4,587,905 | A | 5/1986 | Maki |

(Continued)

FOREIGN PATENT DOCUMENTS

| | | |
|---|---|---|
| JP | S5712300 | 1/1982 |
| WO | WO 2014080136 | 5/2014 |

OTHER PUBLICATIONS

U.S. Office Action dated Nov. 6, 2015 in U.S. Appl. No. 14/269,791.

(Continued)

*Primary Examiner* — J. Woodrow Eldred

(74) *Attorney, Agent, or Firm* — Hartman & Citrin LLC

(57) ABSTRACT

Embodiments of a predictably fragmenting projectile having internally-arranged geometric features are disclosed herein. According to various embodiments, a predictably fragmenting projectile having internally-arranged geometric features can include a substantially solid core of a material; a substantially continuous and smooth outer ogive; a plurality of petals attached to the core and formed from the material, each of the plurality of petals can include a smooth outer surface and can be formed by two break lines formed on the inside of the petals; and a cavity that is located proximate to the core and inner surfaces of the plurality of petals. The fragmenting projectile can be configured to deform by at least one of the plurality of petals pivoting outwardly relative to the cavity.

20 Claims, 6 Drawing Sheets

(56) References Cited

U.S. PATENT DOCUMENTS

| | | | | |
|---|---|---|---|---|
| 4,610,061 | A | 9/1986 | Halverson | |
| 4,777,882 | A | 10/1988 | Dieval | |
| 4,856,160 | A | 8/1989 | Habbe et al. | |
| 5,079,814 | A | 1/1992 | Moore et al. | |
| 5,101,732 | A | 4/1992 | Schluckebier | |
| 5,131,123 | A | 7/1992 | Brooks | |
| 5,208,424 | A | 5/1993 | Schluckebier | |
| 5,259,320 | A | 11/1993 | Brooks | |
| 5,263,418 | A | 11/1993 | Dippold et al. | |
| 5,357,866 | A | 10/1994 | Schluckebier | |
| 5,528,990 | A | 6/1996 | Corzine et al. | |
| 5,943,749 | A | 8/1999 | Swank | |
| 6,148,731 | A | 11/2000 | Winter | |
| 6,305,292 | B1 | 10/2001 | Burczynski | |
| 6,484,642 | B1 | 11/2002 | Kuhns | |
| 6,694,888 | B2 | 2/2004 | Jopson et al. | |
| 6,776,101 | B1 | 8/2004 | Pickard | |
| 6,805,057 | B2 | 10/2004 | Carr et al. | |
| 6,845,717 | B1 | 1/2005 | Sauvestre | |
| 6,935,243 | B2 | 8/2005 | Dippold | |
| 7,162,942 | B2 | 1/2007 | Dippold | |
| 7,743,708 | B1 | 6/2010 | Lawrence | |
| 8,413,587 | B2 | 4/2013 | Emary | |
| 8,578,856 | B2 | 11/2013 | Riess et al. | |
| 8,646,389 | B2 | 2/2014 | Masinelli | |
| 9,046,333 | B2 | 6/2015 | Masinelli | |
| 9,200,878 | B2 | 12/2015 | Seecamp | |
| 9,354,027 | B2 | 5/2016 | Flint | |
| 9,551,555 | B2 | 1/2017 | Flint | |
| 2003/0192425 | A1 | 10/2003 | Olin | |
| 2008/0092768 | A1 | 4/2008 | Krstic | |
| 2008/0314280 | A1 | 12/2008 | Martini Filho | |
| 2010/0018430 | A1 | 1/2010 | Masinelli | |
| 2012/0111220 | A1 | 5/2012 | King | |
| 2013/0092041 | A1 | 4/2013 | Seecamp | |
| 2017/0219325 | A1* | 8/2017 | Smith | F42B 12/74 |

OTHER PUBLICATIONS

U.S. Notice of Allowance dated Mar. 28, 2016 in U.S. Appl. No. 14/269,791.

U.S. Notice of Allowance dated Sep. 8, 2016 in U.S. Appl. No. 15/133,613.

U.S. Office Action dated Oct. 27, 2017 in U.S. Appl. No. 15/412,260.

U.S. Office Action dated Sep. 11, 2018 in U.S. Appl. No. 15/292,542.

U.S. Office Action dated Apr. 15, 2019 in U.S. Appl. No. 15/292,542.

U.S. Notice of Allowance dated Oct. 7, 2019 in U.S. Appl. No. 15/292,542.

U.S. Notice of Allowance dated Apr. 23, 2020 in U.S. Appl. No. 15/292,542.

International Search Report and Written Opinion dated Feb. 6, 2015 in International Application No. PCT/US2014/062138.

Bigslug, "Diemakers—Swaging a Hexagonal (Whitworth) Bullet?," Cast Boolits, May 27, 2012, www.castboolits.gunloads.com.

Grayrock, "PT 145 Owners, Post Here," TaurusArmed.net, Jul. 19, 2014.

"Rainier Peak Performance Delivers Accuracy, Value, Better Terminal Performance and Less Lead Vapor," Rainier Peak Performance, www.rainierballistics.com, Feb. 19, 2015, Rainier Ballistics, LLC.

"Prime 9mm Luger Hexagon 124GR Match +," Prime Ammunition, retrieved at http://www.primeammo.com/9mm-luger-hexagon-124gr.html on Apr. 10, 2016.

"Geco Handgun Ammunition," Geco, retrieved at http://geco-munition.de/en/products/ammo-for-pistols-and-revolver.html on Apr. 10, 2016.

International Search Report and Written Opinion dated Feb. 1, 2018 in International Application No. PCT/US2017/056031.

Supplementary European Search Report and European Search Opinion issued by the European Patent Office in European Patent Application No. 14855305.0 dated May 31, 2017.

* cited by examiner

PREDICTABLY FRAGMENTING PROJECTILES HAVING INTERNALLY-ARRANGED GEOMETRIC FEATURES

CROSS-REFERENCE TO RELATED APPLICATIONS

This application is a continuation of and claims priority to U.S. patent application Ser. No. 15/292,542, entitled "Predictably Fragmenting Projectiles Having Internally-Arranged Geometric Features," filed Oct. 13, 2016, now U.S. Pat. No. 10,663,271, which is incorporated herein by reference in its entirety.

TECHNICAL FIELD

This disclosure relates generally to firearms and ballistic technologies. More particularly, the disclosure made herein relates to a predictably fragmenting projectile having internally-arranged geometric features.

BACKGROUND

Unless otherwise indicated herein, the materials described in this section are not prior art to the claims in this application and are not admitted to be prior art by inclusion in this section.

Firearms are believed to have been invented around the thirteenth or fourteenth century. At that time, firearms consisted of bamboo rods used to guide shrapnel or other projectiles using the force of combusting gunpowder. Over the years, firearms have evolved tremendously, as have the projectiles fired from firearms.

Many early firearms relied on various forms of shrapnel for projectiles. With the evolution of firearms, bullets, and other projectiles similarly have evolved. With the evolution of the musket and similar firearms, spherical lead balls were used for projectiles as the soft lead could be pushed into the barrel easily and still provided a relatively effective projectile. With the advent of modern firearms, particularly in the early part of the nineteenth century, bullets evolved into pointed or conical projectiles. For example, Norton's bullet, named for John Norton of the British Army, was among the earliest pointed projectiles, the precursor of modern bullets and other projectiles.

In the late nineteenth century, copper jacketing processes were introduced to firearm projectiles. Copper jacketing was used to protect the projectile from melting and/or otherwise deforming in the barrel of the firearm due to pressures and heat in the barrel. Thus, copper jacketing allowed bullets to evolve from flying chunks of lead with limited accuracy, speed, and effectiveness into carefully aimed high speed projectiles that maintained their shape in the barrel and during flight.

In the twentieth century, ballistics technologies took many leaps. In the twentieth century, for example, the spitzer bullet shape was introduced, which essentially corresponds to the shape of the modern rifle bullet. Similarly, boat tail bullets were introduced, which further enhanced the accuracy of bullets, as well other shapes and modifications introduced during this time period. During the twentieth century, evolution of overall bullet shape essentially was completed. Thus, bullet makers began increasing the lethality and/or damaging effect of bullets, particularly in the last half of the twentieth century. In particular, the hollow point was introduced to bullets to increase and/or control the expansion (sometimes referred to as the "mushrooming" effect) of the bullet when penetrating or otherwise encountering a target. The hollow point evolved considerably during the last fifty years or so to provide many types of self-defense and hunting ammunition.

One tradeoff often encountered by bullet makers and designers is that penetration of bullets often must be sacrificed for expansion of the bullet in the target. In some targets, the lack of penetration can limit the effectiveness of the bullet. For example, the bullet may expand to a large size, but not contact any vital organs of a target if the bullet does not penetrate into a body cavity of the target. Thus, while the bullet may damage the cutaneous, subcutaneous, and/or even some internal organs of the target, the bullet may lack the effectiveness to neutralize the target due to a lack of penetration.

Similarly, if penetration is prioritized over expansion, the effectiveness of the bullet can be diminished. In particular, a bullet may penetrate a target or even pass through the target without contacting any vital organs and/or without causing sufficient damage to the vital organs to incapacitate the target. Of course, penetration through the target can create or increase a risk of collateral damage to people or objects in the vicinity of the target. For example, a small caliber bullet may pass through a target and pierce organs without neutralizing the target. In the realm of self-defense ammunition, the goal generally is to provide maximum expansion and maximum penetration to attempt to ensure that a threat is neutralized as quickly as possible. Another goal of self-defense ammunition is to expend as much of the projectiles energy as possible within the target.

Some bullet designs intend to increase the penetration and expansion of bullets by relying on fragmentation of the bullets. One approach to providing a fragmenting projectile is to compress discrete pieces of material together with enough force to create a substantially solid projectile that unpredictably disintegrates when encountering a target. Of course, the reliability of such ammunition is not consistent and the fragmentation of the projectile cannot be carefully controlled (the number of pieces can be controlled, but their path and/or shape may or may not be subject to careful control). Some other approaches to providing fragmenting projectiles may require various geometries that can affect the feeding capabilities of the ammunition with respect to certain firearms.

SUMMARY

Concepts and technologies are disclosed herein for providing a predictably fragmenting projectile having internally-arranged geometric features. In some embodiments, the fragmenting projectile is designed to reduce the tradeoff between penetration and expansion. In particular, embodiments of the concepts and technologies described herein can provide a fragmenting projectile that expands in a predictable manner, that penetrates targets effectively, and that has internally-arranged geometric features such that a smooth ogive can still be provided to ensure normal feeding mechanisms of firearms in which the fragmenting projectile is used are capable of functioning properly. In particular, various embodiments of the concepts and technologies described herein are directed to fragmenting projectile that can include an ogive having a smooth outer surface, a base or core ("core") that has two or more petals formed such that the petals are attached to the core, and internal geometric features to provide predictable fragmentation of the fragmenting projectile.

The petals are designed to provide predictable and controlled behavior as the fragmented projectile passes through various media and/or as the fragmenting projectile encounters various types of targets. The behavior can be predicted and controlled based upon geometric features of the fragmenting projectile, which can be set by a manufacturer by selecting tools to form the fragmenting projectile. According to various embodiments, the behavior of the fragmenting projectile can be varied by adjusting length of the fragmenting projectile, thickness of the petals, number of petals and petal geometry, material selection, length of the petals, velocity of the fragmenting projectile, and/or other parameters. In various embodiments, the fragmenting projectile is designed such that the fragmenting projectile can pass through certain types of materials (e.g., hard and/or solid materials such as drywall, glass, cement, clothing, wood, or the like) without fragmenting, while the fragmenting projectile can fragment when encountering a soft or liquid material (e.g., water, ballistics gel, animal or human flesh or tissue, other liquids, or the like).

The predictably fragmenting projectile having internally-arranged geometric features can be configured such that upon encountering a medium that triggers expansion of the fragmenting projectile (e.g., human or animal tissue, water, ballistics gel, or the like) during flight (after firing from a firearm or equivalent motion), hydrodynamic pressure within the core can cause the fragmenting projectile to predictably fail and/or deform along defined geometric features by causing the petals to pivot outward (away from an internal cavity bound by the ogive and the core), break off the core, and "swim" through the target. In some embodiments, the petals can be briefly forced inward after encountering a soft or liquid medium (e.g., toward the inside of the bullet; toward the cavity) and then can be forced outward by the hydrodynamic pressure within the cavity (e.g., by the liquid entering into the cavity). The inner and then outer forces can, in some embodiments, further encourage the deformation and/or failure of the material that defines the petals, thereby encouraging fragmentation of the fragmenting projectile as desired.

In some embodiments, as the petals break off of the core and begin to "swim" away from the core, the movement of the material away from the path of the core can "open" the target (e.g., by forming a moving and growing air pocket within the target), thereby further increasing penetration of the core into the target. Thus, the predictable fragmentation of the fragmenting projectile can be used to provide enhanced penetration by the core. Also, in some embodiments, the movement of the petals can create additional wound channels in the target, thereby increasing the damage caused by the fragmenting projectile within the target and thereby increasing the effectiveness of the fragmenting projectile.

According to one aspect of the concepts and technologies described herein, a predictably fragmenting projectile having internally-arranged geometric features is disclosed. The predictably fragmenting projectile can include a substantially solid core of a material, a substantially continuous and smooth outer ogive; a plurality of petals attached to the core and formed from the material, each of the plurality of petals including a smooth outer surface and being formed by two break lines formed on the inside of the petals; and a cavity that is located proximate to the core and inner surfaces of the plurality of petals. The predictably fragmenting projectile can be configured to deform by at least one of the plurality of petals pivoting outwardly relative to the cavity when engaging a medium or target.

In some embodiments, the break lines can be formed by a broach inserted into a hole that forms at least part of the cavity. In some embodiments, the broach includes a hexagonal broach. In some embodiments, the predictably fragmenting projectile can include a frustum that can be formed at a first end of the predictably fragmenting projectile. In some embodiments, each of the plurality of petals can include a leading edge that can be formed at a second end of the predictably fragmenting projectile.

In some embodiments, the predictably fragmenting projectile can include a break-off notch. The break-off notch can be formed on an outer surface of the predictably fragmenting projectile. In some embodiments, the material can include a copper alloy. In some embodiments, the predictably fragmenting projectile can be formed from a single piece of a copper alloy. In some embodiments, the predictably fragmenting projectile can include a polygonal void that can be formed as part of the cavity and/or that can border and/or include the cavity or a portion thereof.

According to another aspect of the concepts and technologies described herein, a method of forming a predictably fragmenting projectile having internally-arranged geometric features is disclosed. The method can include obtaining, at a machine, a piece of stock material; forming, at the machine and on an external surface of the piece of stock material, an ogive; drilling, by the machine, a hole in a first end of the piece of stock material, the drilling being to a first depth; inserting, by the machine and into the hole, a polygonal broach to a second depth that is less than the first depth; repeating the drilling, by the machine, of the hole to remove scrap material from the hole; and cutting, by the machine, the part to form the predictably fragmenting projectile.

In some embodiments, the stock material can include a copper alloy. In some embodiments, the polygonal broach can include a hexagonal broach. In some embodiments, the method can further include forming a break-off notch in the predictably fragmenting projectile. In some embodiments, the method can further include forming a frustum on the predictably fragmenting projectile.

According to yet another aspect of the concepts and technologies described herein, a predictably fragmenting projectile having internally-arranged geometric features is disclosed. The predictably fragmenting projectile can include a substantially solid core of a material; a substantially continuous and smooth outer ogive; a plurality of petals attached to the core and formed from the material, each of the plurality of petals including an outer surface that includes a portion of the ogive and an inner surface, where each of the plurality of petals can be formed by two break lines located on an inside of the petals; and a cavity that can be defined by the core and inner surfaces of the plurality of petals. The predictably fragmenting projectile can be configured to deform by at least one of the plurality of petals pivoting outwardly relative to the cavity.

In some embodiments, the break lines can be formed by a broach inserted into a hole that forms at least part of the cavity. In some embodiments, the predictably fragmenting projectile can include a break-off notch that can be formed on an outer surface of the predictably fragmenting projectile. In some embodiments, the predictably fragmenting projectile can be formed from a single piece of a copper alloy. In some embodiments, the predictably fragmenting projectile can include a frustum that can be formed at a first end of the predictably fragmenting projectile. In some embodiments, the predictably fragmenting projectile can include a finish located at an outer surface of the predictably fragmenting projectile.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
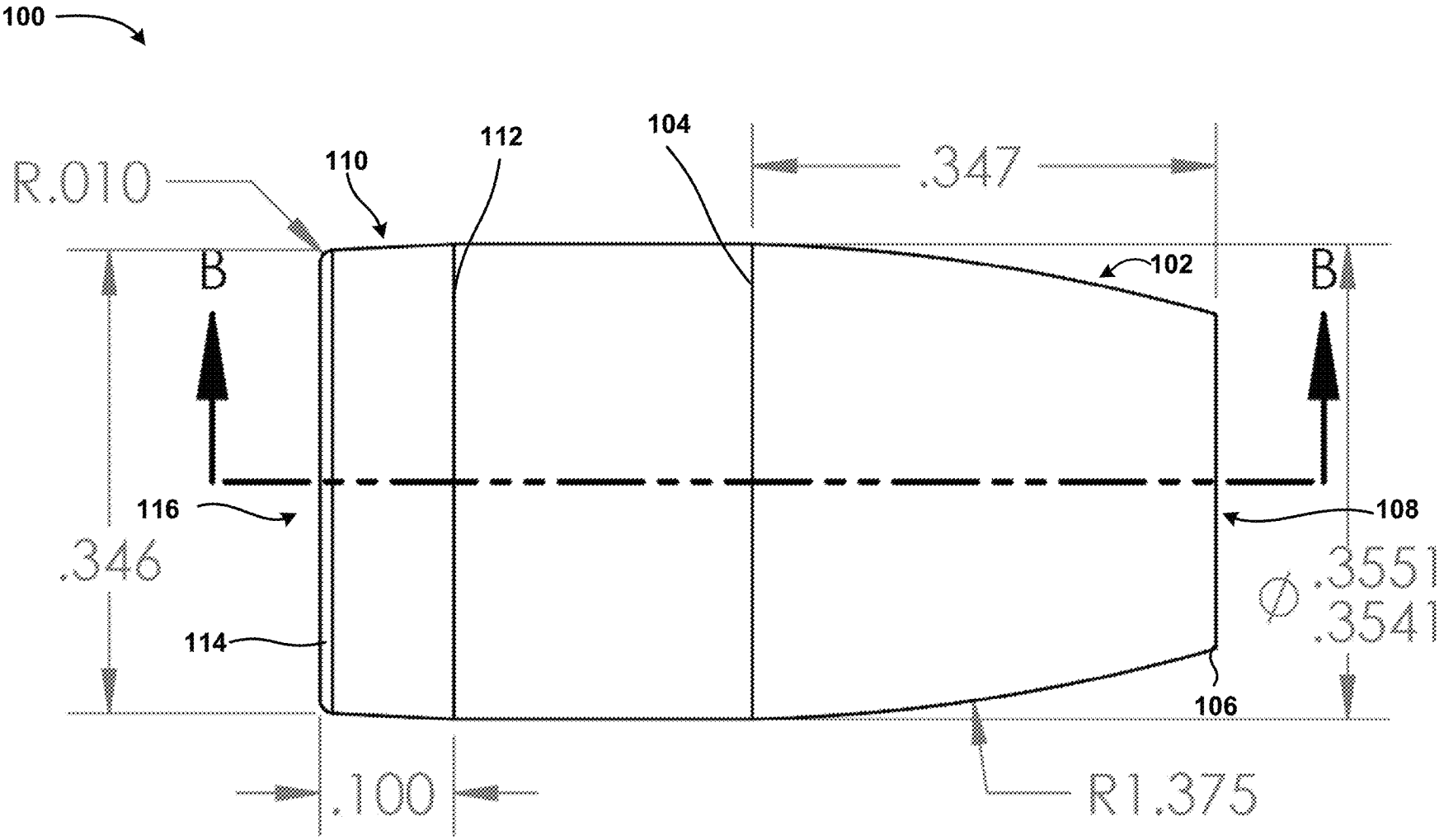
FIG. 1 is a line drawing showing a side elevation view of a predictably fragmenting projectile having internally-arranged geometric features, according to an illustrative embodiment of the concepts and technologies described herein.

The following detailed description is directed to a fragmenting projectile. In some embodiments, a fragmenting projectile can include a base or core ("core") and two or more petals that can be formed such that the petals are attached to the core. Various numbers of petals are contemplated and are possible. In particular, a fragmenting projectile as disclosed herein can include two or more petals. Some embodiments of the fragmenting projectile can include three, four, five, six petals, or more than six petals. In some embodiments, each of the petals can be substantially similar to one another, while in some other embodiments, petals of various sizes and shapes can be formed on one fragmenting projectile. The fragmenting projectile can be designed to provide predictable and controlled behavior as the fragmented projectile passes through various media.

The behavior of the fragmenting projectile can be predicted and controlled based upon various parameters, which can be set by a manufacturer or designed by selecting the tools used to form the fragmenting projectile, the material(s) used to form the fragmenting projectile, and the like. Thus, various geometric aspects of the fragmenting projectile (e.g., overall length of the fragmenting projectile, petal thickness, projectile and petal geometry, cavity diameter and/or depth, shape of the core, material(s) used, presence or absence of grooves or dimples, and/or other features) can affect the performance of the fragmenting projectile. Also, velocity of the fragmenting projectile can affect how and when fragmentation occurs (or does not occur). Thus, it can be appreciated that different embodiments of the concepts and technologies disclosed herein (e.g., embodiments directed to two or more calibers) may not merely include scaled versions of one another—rather different geometry, materials, and the like may be used to provide desired performance characteristics. This will be more clearly understood with reference to the FIGURES and description below.

The petals can be designed to provide predictable and controlled behavior as the fragmented projectile passes through various media and/or as the fragmenting projectile encounters various types of targets. According to various embodiments of the concepts and technologies disclosed herein, the fragmenting projectile is designed such that the fragmenting projectile can pass through certain types of materials (e.g., hard and/or solid materials such as drywall, glass, cement, clothing, wood, or the like) without fragmenting, while the fragmenting projectile can fragment when encountering a soft or liquid material (e.g., water, ballistics gel, animal or human flesh or tissue, other liquids, or the like).

The fragmenting projectile can be configured such that upon encountering a medium that triggers expansion of the fragmenting projectile (e.g., human or animal tissue, water, ballistics gel, or the like) during flight (after firing from a firearm or equivalent motion), hydrodynamic pressure within the core can cause the fragmenting projectile to predictably fail and/or deform along defined geometric features by causing the petals to pivot outward (away from an internal cavity bound by the ogive and the core), break off the core, and "swim" through the target. In some embodiments, the petals can be briefly forced inward after encountering a soft or liquid medium (e.g., toward the inside of the bullet; toward the cavity) and then can be forced outward by the hydrodynamic pressure within the cavity (e.g., by the liquid entering into the cavity). The inner and then outer forces can, in some embodiments, further encourage the deformation and/or failure of the material that defines the petals, thereby encouraging fragmentation of the fragmenting projectile as desired.

In some embodiments, as the petals break off of the core and begin to "swim" away from the core, the movement of the material away from the path of the core can "open" the target (e.g., by forming a moving and growing air pocket within the target), thereby further increasing penetration of the core into the target. Thus, the predictable fragmentation of the fragmenting projectile can be used to provide enhanced penetration by the core. Also, in some embodiments, the movement of the petals can create additional wound channels in the target, thereby increasing the damage caused by the fragmenting projectile within the target and thereby increasing the effectiveness of the fragmenting projectile.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of fragmenting projectiles will be presented.

Figure 2:
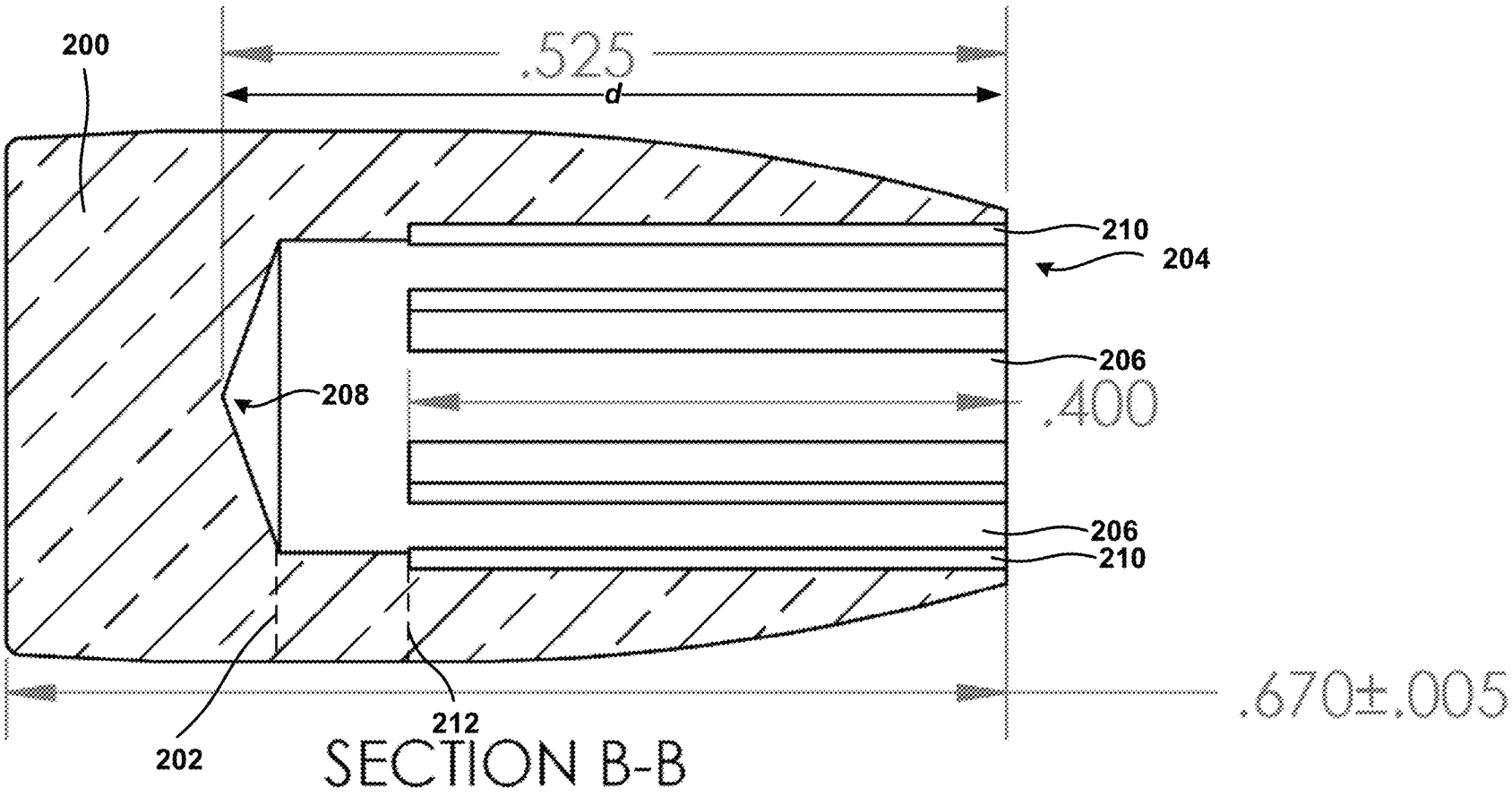
FIG. 2 is a line drawing showing a sectional side elevation view of the predictably fragmenting projectile having internally-arranged geometric features illustrated in FIG. 1, according to an illustrative embodiment of the concepts and technologies described herein.
Figure 3:
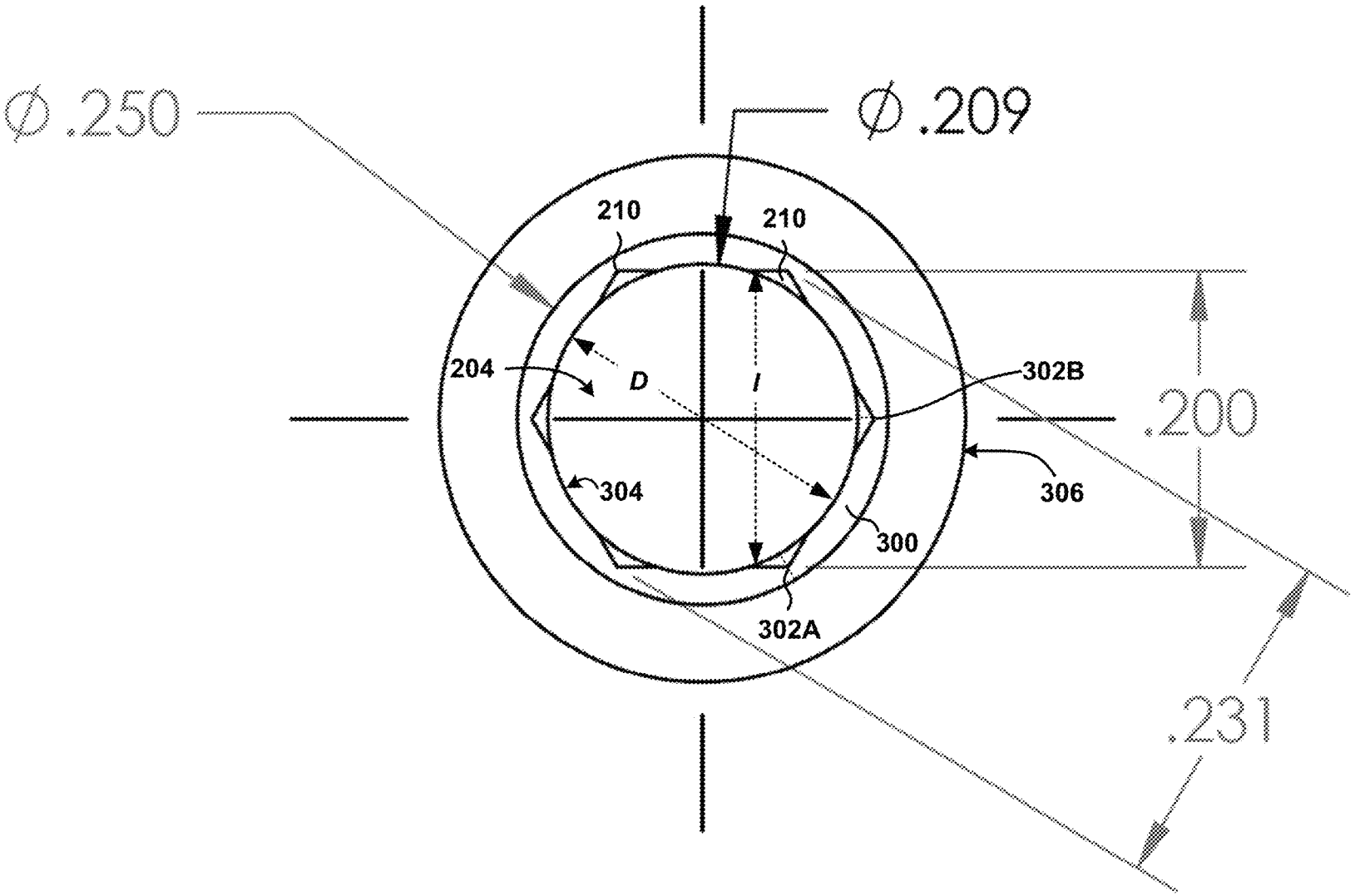
FIG. 3 a line drawing showing a front elevation view of a predictably fragmenting projectile having internally-arranged geometric features, according to an illustrative embodiment of the concepts and technologies described herein.

Referring now to FIGS. 1-3, some aspects of a fragmenting projectile according to various embodiments of the concepts and technologies described herein will be described in detail. In particular, FIGS. 1-3 illustrate a fragmenting projectile 100 according to one example embodiment of the concepts and technologies described herein. As shown in FIG. 1, the fragmenting projectile 100 can have an ogive-shaped portion ("ogive") 102. The ogive 102 can have a substantially smooth and continuous surface. As used herein and in the claims, a substantially "smooth and continuous" surface can refer to a surface that does not include substantial functional geometry (other than the hollow point, ogive, frustum, etc.) on the outside surface from a beginning 104 of the ogive 102 to an end 106 of the ogive 102. In other words, the word "smooth" and/or "continuous" as used herein and in the claims, refers to the fact that the geometry that causes the fragmentation of the fragmenting projectile 100 is located internal to the fragmenting projectile 100 and that from a side profile view of the fragmenting projectile 100 (e.g., the view shown in FIG. 1), the fragmenting projectile 100 may not appear different from a traditional hollow point projectile of a similar caliber. It should be understood that this example is illustrative, and therefore should not be construed as being limiting in any way.

It must be understood, however, that a "smooth" and/or "continuous surface" does not limit a fragmenting projectile 100 to an embodiment that has a perfectly smooth and/or perfectly continuous outer surface. When compared to the R.I.P. brand ammunition from G2 Research Inc. of Winder, Ga., however, the fragmenting projectile illustrated and described herein can be considered to have a substantially smooth and continuous surface that appears to be similar, at first glance, to a traditional hollow point projectile. Such a configuration can assist in feeding of the fragmenting projectile 100 in most firearms. It can be appreciated, however, that some geometry (e.g., ridges, finishes, paints, designs, etc.) may be added to the fragmenting projectile for aesthetics, if desired, without departing from the scope of the disclosure and/or the claims. It can be appreciated from FIG. 1 that the end 106 of the ogive 102 can correspond to a beginning of a nose 108 of the fragmenting projectile 100. As will be clearer with reference to FIGS. 2-3, the nose 108 of the fragmenting projectile 100 can correspond to a hollow point of the fragmenting projectile 100. It should be understood that this example is illustrative, and therefore should not be construed as being limiting in any way.

The fragmenting projectile 100 also can include a frustum 110, which can begin at a point 112 along the surface of the fragmenting projectile 100. The frustum 110 can include and/or can be connected to a chamfer or fillet 114 that can terminate at a first end at the frustum 110 and at a second end at a base 116 of the fragmenting projectile 100. The frustum 110 can be included in some embodiments to assist in stabilization of the fragmenting projectile 100 in flight, to reduce contact between the outer surface of the fragmenting projectile 100 and a barrel of a firearm from which the fragmenting projectile 100 is fired, to assist in seating the fragmenting projectile 100 during loading of ammunition that includes the fragmenting projectile 100, and/or for other purposes. It should be understood that this example is illustrative, and therefore should not be construed as being limiting in any way.

With additional reference to FIG. 2, which is a sectional view of the fragmenting projectile 100 illustrated in FIG. 1 as viewed along cut line B-B, additional aspects of the concepts and technologies disclosed herein will be described in detail. It can be appreciated with additional reference to FIG. 2 that the fragmenting projectile 100 can also include a core 200. In some embodiments, the core 200 can be configured as a substantially smooth and/or substantially continuous solid cylindrical portion of material that is used to form the fragmenting projectile 100. Thus, the core 200 can be defined as the material between the base 116 of the fragmenting projectile 100 and level 202 of the fragmenting projectile 100 at which structures associated with a cavity 204 of the hollow point and/or at which one or more petals 206 of the fragmenting projectile 100 begin and/or at which associated structures are formed. It should be understood that this example is illustrative, and therefore should not be construed as being limiting in any way.

The formation of the cavity 204 will be illustrated and described in more detail below, particularly with reference to FIG. 7. Briefly, a hole that corresponds to a diameter of the cavity 204 can be drilled or otherwise formed in the fragmenting projectile 100. According to various embodiments, the hole can be drilled to a depth d, which can be measured from the nose 108 of the fragmenting projectile 100 to a deepest point 208 associated with the cavity 204. In some embodiments, the angle of the surfaces that meet at the deepest point 208 shown in FIG. 1 can have an angle (relative to one another) of about one hundred forty degrees. It should be understood that this example is illustrative, and therefore should not be construed as being limiting in any way. According to various embodiments, the deepest point 208 of the cavity 204 can be formed from a tip of a drill bit used to form the cavity 204, though this is not necessarily the case. In the example embodiment shown in FIG. 2, the depth d is illustrated as 0.525 inches. It should be understood that this example is illustrative, and therefore should not be construed as being limiting in any way.

After forming the hole, a broach or other suitable tool can be inserted into the hole to form one or more break lines 210. It therefore can be appreciated that the broach can form a polygonal void that can border, include, and/or join the cavity 204. The break lines 210 can correspond, in various embodiments, to borders of the petals 206. According to some embodiments, the broach or other suitable tool can have a polygonal cross-sectional shape. In one contemplated embodiment, including the embodiment illustrated in FIGS. 1-3, the broach corresponds to a hexagonal broach, and as such, six petals 206 can be formed by the broach. It should be understood that this example is illustrative, and therefore should not be construed as being limiting in any way.

As shown in FIG. 2, the broach can be inserted into the hole to a second depth $d_2$, which can correspond to a depth from the nose 108 to a second level 212. It can be appreciated with reference to FIG. 2 that the second level 212 and the level 202 can be different. Thus, the petals 206 can be formed by break lines 210 that can terminate at a depth that is less than a depth at which the cavity 204 terminates. It should be understood that this example is illustrative, and therefore should not be construed as being limiting in any way.

As noted above, the FIGURES are not necessarily to scale. As such, it must be understood that the level 202 and/or the second level 212 can be shifted away from or toward the base 116 and/or away from or toward the nose 108 without departing from the scope of this disclosure. Similarly, the thickness of the break lines 210, the angles associated with the deepest point 208, the angles and/or shapes associated with the ogive 102, the angles and/or structures associated with the frustum 110, and/or other geometric aspects of the fragmenting projectile 100 can be varied without departing from the scope of various embodiments of the concepts and technologies disclosed herein. As such, the illustrated embodiment should be understood as being illustrative of one contemplated embodiment and therefore should not be construed as being limiting in any way. In particular, in some embodiments, the core 200 can contain about one third of the total mass of the fragmenting projectile 100, which can correspond to about one quarter of the total length of the fragmenting projectile 100, while in some other embodiments, the core 200 can correspond to less than a third of the total mass of the fragmenting projectile 100 and/or more than one third of the total mass of the fragmenting projectile 100.

In some embodiments, the core 200 can contain about one half of the total mass of the fragmenting projectile 100, which can correspond to about one quarter to one half of the total length of the fragmenting projectile 100, depending on thickness of the petals, the thickness of the core, and/or other geometric features as illustrated and described herein. In still other embodiments, the core 200 can represent between one half to two thirds of the total mass of the fragmenting projectile 100, which can correspond to about one half to three quarters of the total length of the fragmenting projectile 100, again depending on the various geometric features of the fragmenting projectile 100 as illustrated and described herein. Thus, it should be understood that the core 200 can represent from about one quarter to about three quarters of the total mass of the fragmenting projectile 100 and can represent from about one quarter to about three quarters of the total length of the fragmenting projectile 100, though some embodiments of the concepts and technologies disclosed herein can include more than three quarters of the total mass of the fragmenting projectile 100 or less than one quarter of the total mass of the fragmenting projectile 100. As such, the illustrated embodiments must be understood as being illustrative and should not be construed as being limiting in any way.

With additional reference to FIG. 3, the various structures of the fragmenting projectile 100 can be seen from another angle and will be further described. As noted above, the fragmenting projectile 100 can include two or more petals 206. In the embodiment shown in FIGS. 1-3, the fragmenting projectile 100 includes six petals 206. It should be understood that this example is illustrative, and therefore should not be construed as being limiting in any way.

From the view shown in FIG. 3 (which can correspond to a view toward the nose 108 of the fragmenting projectile 100), the results of using the hexagonal broach as described above can be seen. In particular, it can be appreciated that a diameter D can be slightly larger than a length measured from one surface of the broach to another (as shown by the line labeled/in FIG. 3). It should be understood that this example is illustrative, and therefore should not be construed as being limiting in any way. In FIG. 3, the polygonal (in this case hexagonal) void is also visible.

According to various embodiments, the tips of the broach (or other suitable tool) can form the break lines 210 illustrated and described above with reference to FIGS. 1-2. According to some embodiments, as will be illustrated and described in more detail below with reference to FIG. 7, the broach (or other suitable tool) can be inserted in to a hole that has been drilled to form the cavity 204, and after the broach is removed, the hole can again be drilled to remove scrap and/or material that may be left behind by the broach. It should be understood that this example is illustrative, and therefore should not be construed as being limiting in any way.

According to various embodiments of the concepts and technologies described herein, the petals 206 can have a smooth leading edge 300. The leading edge 300 of the petals 206 can be defined as the material of the fragmenting projectile 100 that is located between the break lines 210 and/or imaginary lines 302A-B that can radially extend outward from the break lines 210 at an inner surface 304 of the petals 206 (the surfaces that border and/or define the cavity 204) to an outer surface 306 of the fragmenting projectile 100. In some other embodiments, the leading edge 300 can have other structures formed thereon such as projections, points, or other structures. As such, it should be understood that the illustrated embodiment is illustrative and should not be construed as being limiting in any way.

In some embodiments, the petals 206 can be configured to open and to break off or fragment from the core 200 under certain conditions. According to various embodiments of the concepts and technologies described herein, the petals 206 can be configured to break off of the core 200 when the fragmenting projectile 100 engages a soft medium such as liquid, gel, flesh, tissue, or the like. When the soft material enters the cavity 204, hydrodynamic pressure within the cavity 204 can force the petals 206 outward. As the fragmenting projectile 100 expands, the material used to form the fragmenting projectile 100 can fail along the break lines 210, and the petals 206 can separate from one another. As the petals 206 pivot outwardly (relative to the cavity 204), the petals 206 can separate from the core 200. It should be understood that these examples are illustrative and therefore should not be construed as being limiting in any way.

According to various embodiments, the petals 206 can be configured with various shapes, dimensions, configurations, and/or relative dimensions and/or configurations. Although the core 200 is illustrated as having an indentation (formed by a drill bit or the like), it should be understood that this is not necessarily the case. Other structures can be formed on the core 200 and can project into the cavity 204 if desired. Thus, it can be appreciated that while the surfaces associated with the deepest point 208 are illustrated as descending away from the cavity 204, other structures and/or surfaces of the core 200 can extend into and/or toward the cavity 204 from the core 200, if desired. It should be understood that this example is illustrative, and therefore should not be construed as being limiting in any way.

Also, while the petals 206 are illustrated as being formed from a substantially v-shaped channel by the broach (e.g., at the break lines 210), it should be understood that other shapes can be associated with the break lines 210. For example, a tool having a planar shape can be inserted into the hole associated with the cavity 204 to form slits instead of v-shaped notches as the break lines 210. The hexagonal broach, however, is a preferred embodiment and therefore is illustrated herein. The v-shaped notches associated with the break lines 210 can therefore be understood as having one or more surfaces, two or more facets, and/or various structures and/or configurations based on the tooling used to form the fragmenting projectile 100. It should be understood that these examples are illustrative, and therefore should not be construed as being limiting in any way.

In some other embodiments, the break lines 210 can be formed using a broach having rounded corners so that the break lines 210 can have rounded surfaces. Thus, while the break lines 210 are shown as corresponding to v-shaped channels, it should be understood that this shape is illustrative of one contemplated embodiment, and therefore should not be construed as being limiting in any way. The break lines 210 can be formed to provide a weak area in the fragmenting projectile 100, thereby encouraging intentional failure of the fragmenting projectile 100 at the break lines 210 to create the petals 206. It should be understood that this example is illustrative and therefore should not be construed as being limiting in any way.

Figure 4:
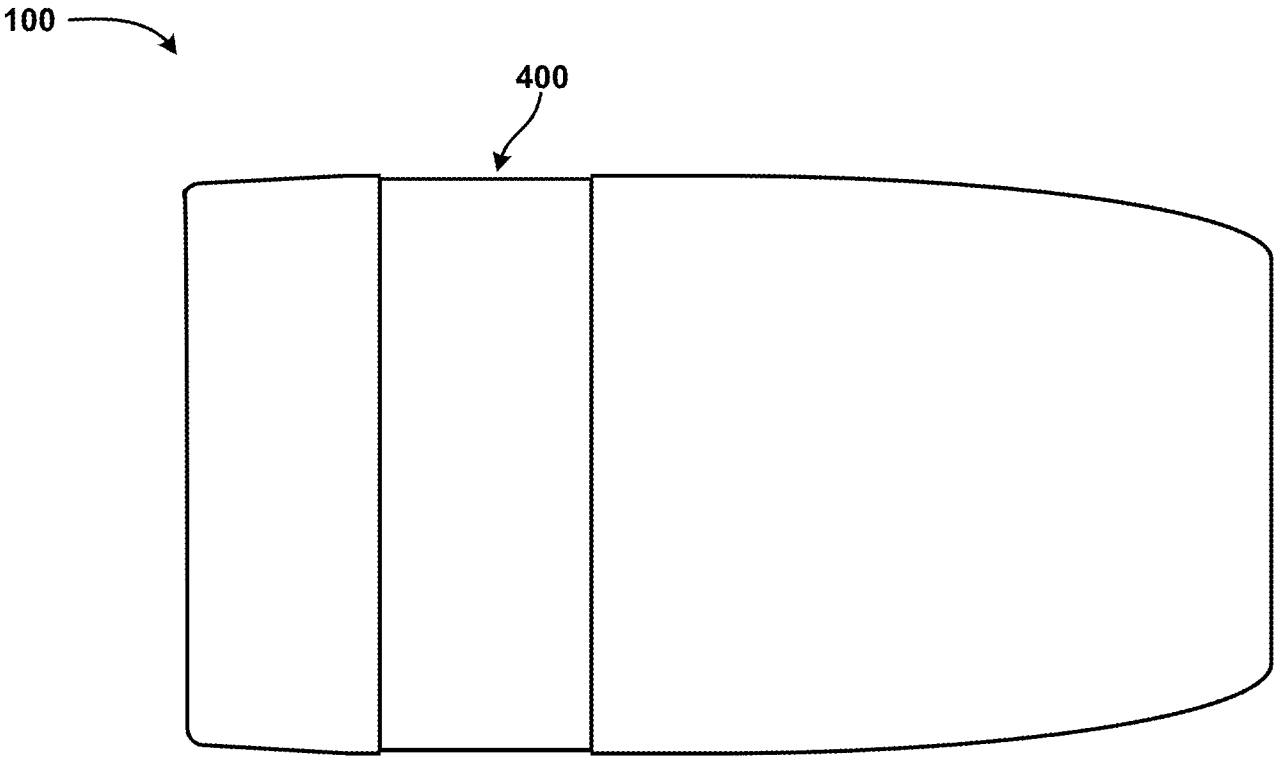
FIG. 4 is a line drawing showing a side elevation view of a predictably fragmenting projectile having internally-arranged geometric features, according to another illustrative embodiment of the concepts and technologies described herein.

With reference to FIG. 4, additional features of the fragmenting projectile 100 will be described. As shown in FIG. 4, the fragmenting projectile 100 also can include one or more break-off notches 400. According to various embodiments, the break-off notch 400 can be formed such that the break-off notch 400 is not visible when the fragmenting projectile 100 is loaded into a cartridge (as the break-off notch 400 can be located under the top edge of the cartridge). Similarly, it should be understood that various embodiments of the concepts and technologies disclosed herein can result in a fragmenting projectile 100 that appears smooth on the outer surface (with the internally-arranged geometry being visible only when looking into the cavity 204). It should be understood that this example is illustrative, and therefore should not be construed as being limiting in any way.

The break-off notches 400 can be formed by removing material from the fragmenting projectile 100 at one or more selected locations. In the illustrated embodiment, a single break-off notch 400 can be included by removing material at a portion of the outer surface of the fragmenting projectile 100. The break-off notch 400 can be included to further weaken material of the fragmenting projectile 100 at or near a location at which the failure of the material is desired. Thus, the break-off notch 400 can be used to designate a location on the fragmenting projectile 100 at which the petals 206 will fragment or break off from the core 200 when deformation and/or expansion of the fragmenting projectile 100 is triggered. As will be illustrated and described in more detail below, the petals 206 can break off from the core 200 at or near the level 202, though this is not necessarily the case. The break-off notch 400 can be included to further encourage failure at or near a particular location for various reasons. Because the petals 206 can break off elsewhere, and because the fragmenting projectile 100 can include additional and/or alternative structures, it should be understood that this example is illustrative and therefore should not be construed as being limiting in any way.

As mentioned above, the petals 206 can be slightly bent and/or can move along an arc-shaped path after separating from the core 200. The arc-shaped path will be illustrated and described with reference to FIGS. 5-6. Because the spreading and/or distribution of the petals 206 can be controlled by modifying various parameters of the fragmenting projectile 100 as mentioned above, it should be understood that the illustrated embodiment is illustrative and therefore should not be construed as being limiting in any way. Furthermore, as noted above, the number of petals 206 can be varied without departing from the scope of the disclosure. Thus, the embodiment shown in FIGS. 9-10, wherein the fragmenting projectile 100 includes six petals should not be construed as being limiting in any way.

Figure 5:
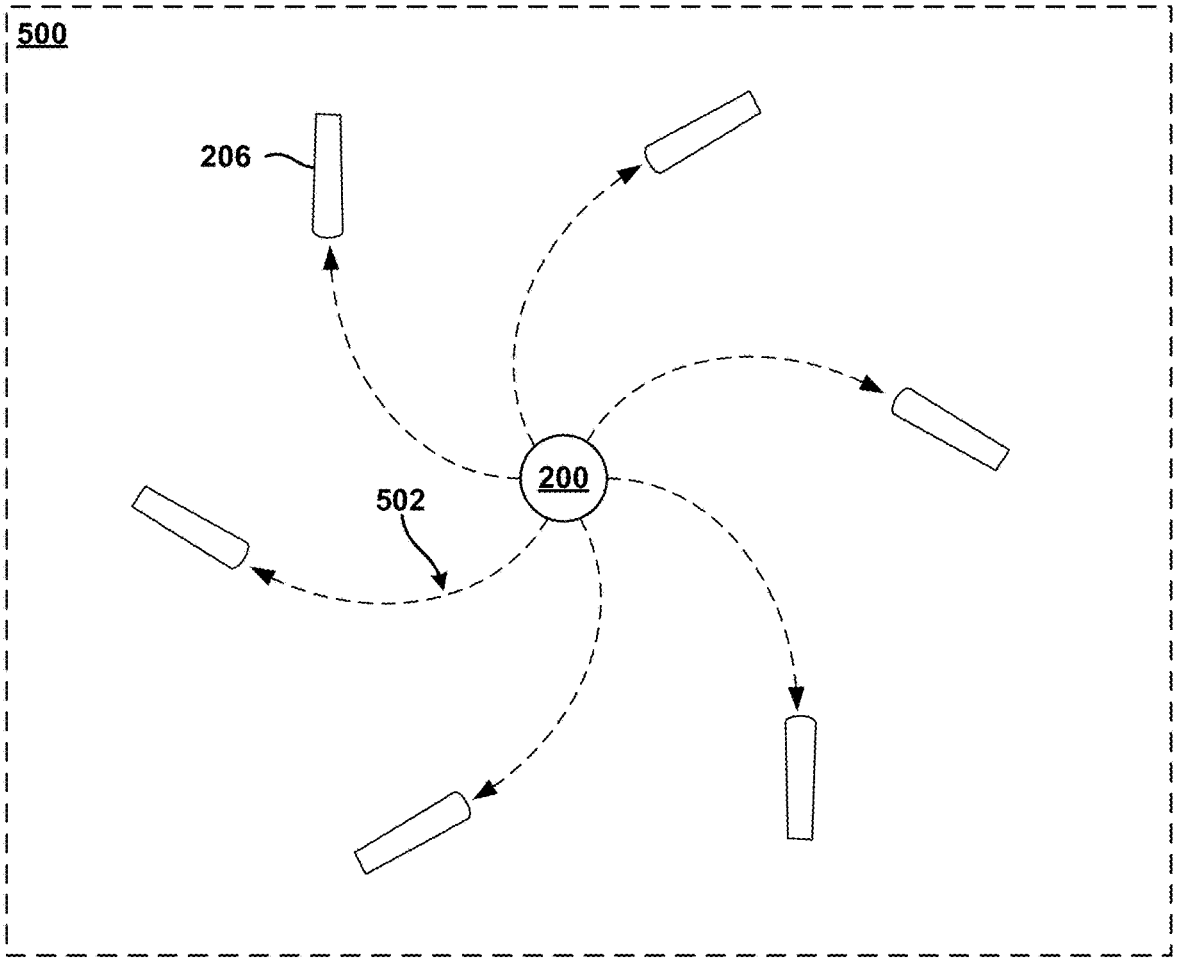
FIG. 5 is a line drawing schematically illustrating fragmentation of a predictably fragmenting projectile having internally-arranged geometric features, according to some illustrative embodiments of the concepts and technologies described herein.

Turning now to FIG. 5, additional aspects of the fragmenting projectile 100 will be described in detail. In particular, FIG. 5 is a line drawing schematically illustrating how the petals 206 travel after fragmentation of the fragmenting projectile 100, according to one illustrative embodiment. In FIG. 5, the fragmenting projectile 100 enters a medium 500 such as flesh, gel, liquid, tissue, or the like. Thus, the medium 500 can correspond to a soft medium as described herein, though this is not necessarily the case.

Upon entering the medium 500, the petals 206 of the fragmenting projectile 100 can bend outward away from the cavity 204, as explained above. As noted above, the petals 206 may first bend slightly toward the cavity 204, though this is not necessarily the case. As explained above, the fragmenting projectile 100 can be designed such that the petals 206 break away from the core 200 during bending of the petals 206. After breaking away from the core 200, the rotational energy of the fragmenting projectile 100 can be at least partially imparted to the petals 206. Similarly, the petals 206 can be moving at about the same speed as the fragmenting projectile 100, and as such, the petals 206 may be moving along a path associated with the fragmenting projectile 100 at substantially the same rate of speed as the core 200.

Figure 6:
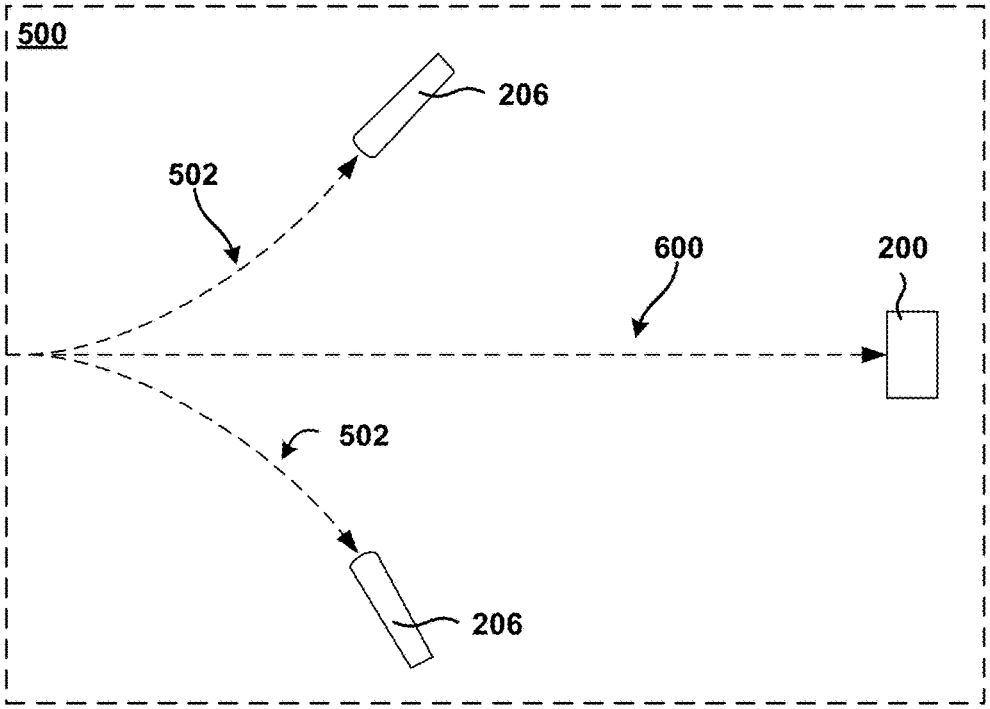
FIG. 6 is a line drawing schematically illustrating a side view of fragmentation of a predictably fragmenting projectile having internally-arranged geometric features, according to some illustrative embodiments of the concepts and technologies described herein.

Still further, as explained above, the petals 206 may include a slight arc-shape or bend that can cause the petals 206 to "swim" along a path 502 away from the core 200. In some embodiments, the path 502 can be an arc-shaped path. Thus, in some embodiments of the fragmenting projectile 100, the petals 206 may spread away from the core 200 along arc-shaped paths that are arc-shaped in zero, one, or even two dimensions. Thus, in some embodiments, the petals 206 can spread out along an arc-shaped path as shown in FIG. 6. In some other embodiments, the petals 206 can spread out in linear paths. In still other embodiments, the petals 206 can spread out along arc-shaped paths that are arc-shaped in two dimensions, similar to a helix shape.

The shape of the paths 502 in an embodiment wherein the petals 206 spread out along arc-shaped paths that are arc-shaped in two dimensions can be more easily understood and appreciated with collective reference to FIGS. 5-6, with FIG. 6 representing a side view of the configuration shown in FIG. 5. It should be noted that only two petals 206 are illustrated in FIG. 6 to avoid obscuring the view of the petals 206 and/or their respective paths 502. Furthermore, as explained above, the petals 206 can spread out along linear paths and/or other shaped paths, and as such, it should be understood that the example illustrated in FIGS. 5-6 is illustrative and therefore should not be construed as being limiting in any way.

As shown in FIG. 6, the core 200 can continue along a core path 600, which can be approximately linear in some embodiments. Thus, the fragmenting projectile 100 can provide expansion and penetration, as will be illustrated and described in more detail below. Because the design of the fragmenting projectile 100 can be modified to change the paths 502 of the petals 206 and/or the core path 600 of the core 200, it should be understood that this example is illustrative and therefore should not be construed as being limiting in any way.

The fragmenting projectile 100 can be designed to expend as much energy as possible within a target. Upon contacting a target, the fragmenting projectile 100 can be rotating (from rotational energy imparted by rifling in the barrel of the firearm from which the fragmenting projectile 100 is fired). Upon entering the target, the fragmenting projectile 100 can begin to decelerate and the cavity 204 can fill with material from the target. As the material enters into and/or flows into the cavity 204, hydrodynamic pressure associated with the buildup of material (particularly fluid associated with the material) can build within the cavity 204. This hydrodynamic pressure can force the petals 206 outward (away from the cavity 204), until the petals 206 fracture or split from the core 200.

The petals 206 of the fragmenting projectile 100 can open by bending outward away from the cavity 204 as illustrated and described above. The hydrodynamic pressure can continue to increase and the continued movement of the petals 206 can result in the material at the break lines 210 fracturing (or otherwise failing) such that the petals 206 separate along the break lines 210. As noted above, the petals 206 also can separate from the core 200 at or near break-off notches 400, if included. When the petals 206 are pushed to a chosen number of degrees (which can be set by modifying parameters as disclosed herein), the petals 206 can split off of the core 200 and can move away from the core 200 and into the target due to inherited momentum imparted by rotational energy of the fragmenting projectile as illustrated and described herein.

Due to the petals 206 splitting off of the core 200, the mass of the core 200 can be reduced significantly. As explained above, the core 200 can include from about one quarter to about three quarters of the total mass of the fragmenting projectile 100 (or more or less). Thus, the sudden reduction of mass of the core 200 can limit the penetration of the core 200 into the target to reduce the odds that the core 200 will pass through the target. Furthermore, the petals 206 can carry with them some of the energy from the fragmenting projectile 100, individually, which can result in the petals 206 being pushed farther into the target. It should be understood that this example is illustrative and therefore should not be construed as being limiting in any way.

The shape of the petals 206 and the point during opening of the petals 206 at which the petals separate from the core 200 generally results in the petals 206 spreading at about a sixty degree angle relative to the original path of the fragmenting projectile 100. Drag on the petals 206 that can be induced by the medium through which the petals 206 move can push the petals 206 to expand outward beyond a diameter of the original fragmenting projectile 100. This movement of the petals 206 can create a shock wave or otherwise cause creation of a temporary void in the target or other medium, which, as noted above, can encourage yet further penetration of the core 200 by creating a temporary void. This void can result in the core 200 experiencing less resistance than otherwise would be encountered (without the spreading petals 206 to create the temporary void). Thus, the core 200 can move into the target before encountering full resistance of the medium associated with the target. This, in turn, can increase penetration of the core 200 into the target, in some embodiments. As explained above, the penetration of the core 200 can be controlled by controlling various parameters of the fragmenting projectile 100.

As noted above, paths of the petals 206 within the target may not be linear after they have separated from the core 200. Due to the rotation of the fragmenting projectile 100 before engaging the target, the petals 206 may have a tendency to travel in an arc. This movement in an arc can increase the likelihood of a petal 206 contacting a vital organ within the target. It has been noted that the petals 206 also can rotate end over end predictably over their distance of travel, which further can increase the destructive effect of the petals 206 within the target. Modifications to the tip of the petal 206 or the tail can be made to affect how the petals 206 pass through a material.

The fragmenting projectile 100 can be formed using various manufacturing processes and/or tools. In some embodiments, the fragmenting projectile 100 is die cast as one piece and/or as two pieces that are later joined together. In some other embodiments, the fragmenting projectile 100 can be formed from a solid piece of material that can be machined using routers, mills, lathes, and/or various CNC machines, as generally is understood, without any casting processes. Thus, in some embodiments the fragmenting projectile 100 is formed from a single piece of material, while in other embodiments the fragmenting projectile 100 is formed from multiple pieces of material. One method for forming the fragmenting projectile 100 is illustrated and described herein with reference to FIG. 7.

Various machining techniques can be used in accordance with the concepts and technologies disclosed herein. A Swiss-style machining approach may be used, in some embodiments. In particular, the tools may be held stationary, and the material can be moved about the spinning tool to form the fragmenting projectile 100. It should be understood that these examples are illustrative and therefore should not be construed as being limiting in any way.

The fragmenting projectile 100 can be formed from various metals or alloys. It has been discovered that different materials, different alloys, and/or even different specifications for a single material can provide different performance for substantially identical geometries. In some embodiments, malleable materials may be used to provide a fragmenting projectile 100 that opens up upon impact, but does not shed its petals 206 (i.e., does not fragment per se). Slight changes to powder charge can increase the speed of such a fragmenting projectile 100 and result in the petals 206 shedding or separating from the core 200, even with malleable materials.

According to various embodiments, the fragmenting projectile 100 can be formed from solid copper or solid copper alloys, though this is not necessarily the case, as various alloys and or composite materials can be used in accordance with the concepts and technologies described herein. In some embodiments, copper-based alloys can provide ease of manufacturing (e.g., machining characteristics may be ideal), as well as ductility and/or malleability. In some embodiments, the fragmenting projectile 100 is formed from a tellurium-copper (TelCu) alloy known as C145 (0.5% tellurium), which can support a dual behavior in solids and liquids/gels of the fragmenting projectile 100. In some other embodiments, the fragmenting projectile 100 is formed from a sulfur bearing copper alloy known as C147 (about 0.002-0.0005% Phosphorous, about 0.20-0.50% Sulfur, and remainder Copper), which can support the dual behavior in solids and liquids/gels of the fragmenting projectile 100.

In another embodiment, the fragmenting projectile 100 can be formed from an oxygen free copper alloy known as C101, which can support expansion of the petals 206 without readily supporting separation (or without allowing separation) of the petals 206 because the material is more malleable than C145 or C147. As noted above, particular alloys can be specified to affect the performance of the fragmenting projectile 100, for example how far into the target the fragmenting projectile 100 penetrates into a particular medium prior to deployment and/or separation of the petals 206, as well as other aspects of the performance of the fragmenting projectile 100. As such, the fragmenting projectile 100 can be formed from various materials, and the above examples should be understood as being illustrative and therefore should not be construed as being limiting in any way.

According to various embodiments of the concepts and technologies described herein, the fragmenting projectile 100 is formed from C145 copper alloy, but a custom range of tensile strength is applied. In particular, according to various embodiments of the concepts and technologies described herein, the fragmenting projectile 100 can be formed from a C145 alloy that has a tensile strength within a range of 36-41 kilopounds per square inch (ksi), with an optimal tensile strength of 37.5 ksi. As is known, this tensile strength range exceeds the ASTM-B-301 standard for tensile strength range for C145. In some embodiments, the Applicant and/or some of the Applicant's suppliers may refer to a material that complies with this heightened standard for tensile strength as complying with the "G2 Specification" or the "G2 SPEC," though this is not necessarily the case. It should be understood that other copper alloys can be used, and that the above example embodiment is illustrative. As such, this embodiment should not be construed as being limiting in any way.

Various alloys can support different performance of the fragmenting projectile 100, as explained above. In particular, if the fragmenting projectile 100 is formed from a malleable material, the fragmenting projectile 100 may not lose its petals 206 as readily as a fragmenting projectile 100 with the same geometry that is formed from a material that is less malleable. As explained above, this may be desirable, in some instances, as the petals 206 of the fragmenting projectile 100 may open up without fragmenting from the core 200. In particular, the petals 206 may open to approximately 90-degrees and remain attached to the core 200. This embodiment can cause severe damage to the target while preventing penetration through the target and may be preferred in some instances.

In some other embodiments, the material for the fragmenting projectile 100 is selected to ensure that the petals 206 break off from the core 200 and therefore may be more brittle compared to the material used for an fragmenting projectile 100 in which separation of the petals 206 is not desired. Geometry of the fragmenting projectile 100 can affect separation (or a lack thereof) even more than material choice however.

In one contemplated embodiment, a hybrid fragmenting projectile 100 is provided by using a malleable material but making variations in the geometry to cause some petals 206 to open and to cause some other petals 206 to separate. Thus, for example, cuts may be made in the fragmenting projectile 100 near a midsection and may be alternated to every other petal base, internally or externally. In one embodiment, this process can result in a hybrid fragmenting projectile 100 that, upon impact, results in three petals 206 (or other numbers of petals 206) opening and remaining attached to the core 200, while three other petals (or other numbers of petals 206) split off the core 200 and expand outward. It should be understood that this example is illustrative and therefore should not be construed as being limiting in any way.

The concepts and technologies described herein can be applied to numerous calibers of projectiles, various masses or weights of projectiles, and/or various speeds of projectiles. In some embodiments, fragmenting projectiles 100 that exceed speeds of 1400 feet per second may not function as described herein, since high speeds may result in projectiles that pass through the target without expending the energy within the target, though this is not necessarily the case. In one test, a 9 mm fragmenting projectile 100 weighing 92 (+/−1.0) grains was produced from C145 or C147.

The fragmenting projectile 100 used in this test began with a piece of stock material having a diameter of about 0.3551 inches. An ogive 102 was formed with a linear length of about 0.347 inches and a frustum 110 having a length of about 0.1 inches was formed at an opposite end of the fragmenting projectile 100. A chamfer or fillet 114 having a radius of about 0.010 inches was formed at the base 116 of the fragmenting projectile 100, just past the frustum 110. A hole having a diameter of about 0.200 inches was formed in the fragmenting projectile with a depth of about 0.525 inches from the nose 108 to the deepest point 208, corresponding to the tip of the drill bit used to form the hole.

A 5 mm hexagonal broach was inserted into the hole to a depth of about 0.400 inches to yield six break lines 210, where each two break lines 210 formed one of six petals 206. The fragmenting projectiles 100 formed in this manner weighed an average of 92.0 grains. These fragmenting projectiles were loaded into JAG nickel brass with a CCI brand small pistol primer and 4.6 grains of ST MARKS OBP 248 powder. When fired into 10% ballistic gel from three different 9 mm semi-automatic handguns with an average barrel length of 4.00 inches at an average velocity of about 1210 fps, the core 200 of the fragmenting projectile 100 penetrated about twelve inches and the petals 206 penetrated the target to a depth of about 4.7 inches with an expansion diameter of about 5.7 inches. It can be appreciated that this observed penetration exceeds the penetration expected for a round nose 93 grain 9 mm projectile fired at 1,250 fps into bare ballistics gel. It should be understood that this example is illustrative and therefore should not be construed as being limiting in any way.

The test was then repeated with four layers of denim, and the average penetration of the core 200 was again about twelve inches, with a penetration of about four inches for the petals 206 and an expansion diameter of about four inches for the petals 206. The test was again repeated with eight layers of denim, and the average penetration of the core 200 was again about twelve inches, with a penetration of about four inches for the petals 206 and an expansion diameter of about 3.75 inches for the petals 206. The test was yet again repeated with eight layers of denim and one layer of ½" drywall, and the average penetration of the core 200 was about 10.5 inches, with a penetration of about 5.7 inches for the petals 206 and an expansion diameter of about 2.75 inches for the petals 206. The test was repeated once more with one layer of ¾ inch plywood. In this test, the fragmenting projectile 100 did not fragment. Still, the average penetration of the fragmenting projectile 100 was about 13.63 inches. It can be appreciated that these observed penetrations exceed the expected penetrations for round nose 93 grain 9 mm projectiles fired at 1,250 fps. It should be understood that this example is illustrative and therefore should not be construed as being limiting in any way.

In the above-tested ammunition, the average pressure was 36,260 PSI and a SAMMI average of about 35,000. It should be understood that these examples are illustrative, and therefore should not be construed as being limiting in any way.

While the above description has made reference several times to rifling and/or rotation of the fragmenting projectile 100, it should be understood that various embodiments of the concepts and technologies described herein can be used with smooth bore firearms and/or other devices such as rail guns, or the like, that may not use rifling or otherwise induce rotation to the fragmenting projectile 100. Thus, for example, the concepts and technologies described herein can be used to create a fragmenting projectile 100 for use as a shotgun slug, a rail gun projectile, or the like. It should be understood that these examples are illustrative and therefore should not be construed as being limiting in any way.

Figure 7:
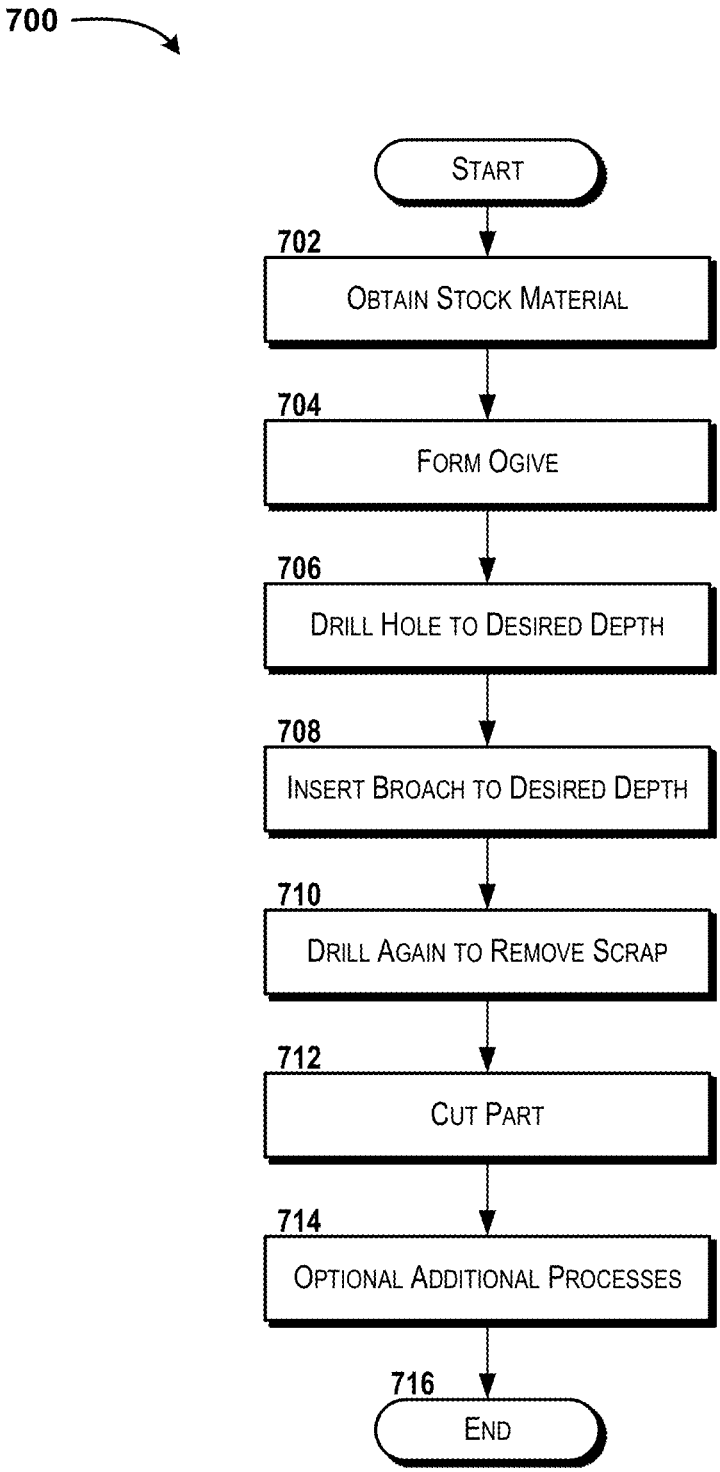
FIG. 7 is a flow diagram that schematically illustrates a method of forming a predictably fragmenting projectile having internally-arranged geometric features, according to an illustrative embodiment of the concepts and technologies disclosed herein.

Turning now to FIG. 7, aspects of a method 700 for forming a predictably fragmenting projectile having internally-arranged geometric features will be described in detail, according to an illustrative embodiment. It should be understood that the operations of the method 700 disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims. It also should be understood that the illustrated method 700 can be ended at any time and need not be performed in its entirety.

For purposes of illustrating and describing the concepts of the present disclosure, the method 700 is described as being performed by a machine such as a CNC machine or other devices (e.g., an assembly line). Some operations of the method 700 may be performed by the machine (or a control system thereof) via execution of one or more software modules such as, for example, a projectile formation application that can execute on a control system or other computing device such as a laptop computer, a tablet computer, smartphone, an embedded control system, a desktop computer, a server computer, or the like. It should be understood that additional and/or alternative devices can provide the functionality described herein via execution of one or more modules, applications, and/or other software including, but not limited to, the projectile formation application. Thus, the illustrated embodiments are illustrative, and should not be viewed as being limiting in any way.

The method 700 begins at operation 702. In operation 702, the machine can obtain stock material. In some embodiments, the stock material comprises a rod of C-147 copper. In some other embodiments, other materials can be obtained as illustrated and described herein. According to one embodiment, the stock material can correspond to a rod of C-147 copper having a tensile strength of about 36-41 ksi and having an outside diameter of about 0.3551 inches if being used to form a 9 mm caliber fragmenting projectile 100. In some embodiments, a first end of the material can be flat. The material can be provided as a rod and fed by the machine to form the parts. It should be understood that this example is illustrative, and therefore should not be construed as being limiting in any way.

Although not explicitly shown in FIG. 7, it should be understood that a frustum 110, a chamfer or fillet 114, a break-off notch 400, and/or other features can be formed on the part in operation 702 (or in other operations). It should be understood that this example is illustrative, and therefore should not be construed as being limiting in any way.

From operation 702, the method 700 proceeds to operation 704. In operation 704, the machine can form the ogive 102. According to various embodiments, the stock material can be rotated by a lathe and a tool can be brought into contact with the stock material to remove stock material to form the ogive 102. Because the ogive 102 can be formed in additional and/or alternative ways, it should be understood that this example is illustrative, and therefore should not be construed as being limiting in any way.

From operation 704, the method 700 proceeds to operation 706. In operation 706, the machine can drill a hole into the stock material. The hole can be drilled to a first depth. It can be appreciated that a drill bit may be used, and that the stock material can be rotated (and the drill bit held stationary, if desired). From operation 706, the method 700 proceeds to operation 708. In operation 708, the machine can insert a broach into the hole formed in operation 706 to create the break lines 210 illustrated and described herein. It can be appreciated that the broach can be inserted into the hole to a second depth that is less than the first depth. Thus, the hole formed in operation 706 can be deeper than an insertion depth associated with the insertion of the broach in operation 708. It should be understood that this example is illustrative, and therefore should not be construed as being limiting in any way.

From operation 708, the method 700 proceeds to operation 710. In operation 710, the machine can again drill the hole formed in operation 706. In operation 710, the hole can be again drilled to remove scrap material that may be left during the insertion of the broach in operation 708. It should be understood that this example is illustrative, and therefore should not be construed as being limiting in any way.

From operation 710, the method 700 can proceed to operation 712. In operation 712, the machine can cut the part at a desired length. Thus, in some embodiments of the method 700, the fragmenting projectile 100 can be formed at operation 712. In some other embodiments, functionality of operation 712 can be skipped and operation 714 can instead be performed. In yet other embodiments, operation 714 can be performed after operation 712. It should be understood that these examples are illustrative, and therefore should not be construed as being limiting in any way.

In operation 714, other processes can be completed. In some embodiments, assist rings can be formed on the fragmenting projectile 100 before or after cutting the part. The assist ring can be substantially identical to the break-off notch 400 illustrated and described herein.

In some other embodiments, operation 714 can include applying one or more coating or finishes to the fragmenting projectile. For example, in some embodiments an anodization process can be performed to form an oxide layer on the fragmenting projectile 100. The anodization process can include a chemical process, an electrochemical process, a heat process, or other processes. In some other embodiments, one or more paint, one or more coating, or one or more other finish (e.g., polished finish, sandblasted finish, satin finish, or the like) can be applied or formed on a surface of the fragmenting projectile 100. It should be understood that this example is illustrative, and therefore should not be construed as being limiting in any way.

In some other embodiments, operation 714 can include a plug process wherein the hole or cavity 204 can be plugged with other materials. Thus, a plug can be formed in the hole or cavity 204. In some embodiments, a plastic or wax plug can be formed in the hole or cavity 204. Other materials can be used to form the plug so this example must be understood as being illustrative and should not be construed as being limiting in any way.

In some other embodiments, operation 714 can include forming multiple components of the fragmenting projectile 100 together (if formed separately). The components can be welded together, melted together, glued together, mechanically coupled together, and/or otherwise joined together. It should be understood that these examples are illustrative, and therefore should not be construed as being limiting in any way.

From operation 714, the method 700 can proceed to operation 716. The method 700 can end at operation 716.

The word "predictable," "predictably," as used with regard to fragmentation refers to the ability to set or predict how the petals 206 fragment from the core 200 in the various embodiments disclosed herein. Thus, the petals 206 are predictable in that the rough shape and size of the petals 206 can be set as shown in the various embodiments illustrated and described herein. This can be set, at least, by modifying the copper used, the number and/or location of the break lines 210, the depth of the hole that forms the cavity 204 and/or the depth of insertion of the broach to form the break lines 210 relative to the hole, the diameter of the hole, and other geometry illustrated and described herein. Thus, the disclosed embodiment is one contemplated embodiment and should not be construed as being limiting of the concepts and technologies disclosed herein.

Based on the foregoing, it should be appreciated that embodiments of a fragmenting projectile have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

The invention claimed is:

1. A predictably fragmenting projectile having a leading edge, a base, and internally-arranged geometric features, the predictably fragmenting projectile comprising:

a substantially solid core of a first material, the core comprising the base;

a substantially smooth ogive comprising the leading edge;

a petal adjacent to the core; and a cavity comprising a first portion and a second portion, the first portion comprising a round void and the second portion comprising a polygonal void, wherein the first portion extends between a first level and a second level, wherein the second portion extends from the second level to the leading edge, and wherein the predictably fragmenting projectile is configured to deform by the petal pivoting outwardly away from the cavity in response to dynamic pressure created by a second material entering the cavity.

2. The predictably fragmenting projectile of claim 1, further comprising a plurality of petals comprising the petal, wherein the plurality of petals are formed from the first material.

3. The predictably fragmenting projectile of claim 2, wherein each of the plurality of petals comprises a portion of the substantially smooth ogive, and wherein the plurality of petals are formed by break lines on an inside surface of the plurality of petals.

4. The predictably fragmenting projectile of claim 3, wherein the break lines correspond to corners formed by the polygonal void.

5. The predictably fragmenting projectile of claim 3, wherein the break lines are formed by a polygonal broach that is partially inserted into a hole that comprises the first portion.

6. The predictably fragmenting projectile of claim 1, wherein the first material comprises a copper alloy.

7. The predictably fragmenting projectile of claim 1, wherein the predictably fragmenting projectile is formed from a single piece of a copper alloy.

8. A predictably fragmenting projectile having a leading edge, a base, and internally-arranged geometric features, the predictably fragmenting projectile comprising:

a substantially solid core of a first material, the core comprising the base;

a substantially smooth ogive, the ogive comprising the leading edge;

a plurality of petals attached to the core and formed from the first material, each of the plurality of petals comprising an outer surface that comprises a portion of the ogive and an inner surface; and a cavity comprising a first portion and a second portion, the first portion comprising a round void and the second portion comprising a polygonal void, wherein the first portion extends between a first level and a second level, wherein the second portion extends from the second level to the leading edge, and wherein the predictably fragmenting projectile is configured to deform by at least one petal of the plurality of petals pivoting outwardly away from the cavity in response to dynamic pressure created by a second material entering the cavity.

9. The predictably fragmenting projectile of claim 8, wherein the plurality of petals are formed by break lines on an inside surface of the plurality of petals.

10. The predictably fragmenting projectile of claim 9, wherein the break lines correspond to corners formed by the polygonal void.

11. The predictably fragmenting projectile of claim 9, wherein the break lines are formed by a polygonal broach that is partially inserted into a hole that comprises the first portion.

12. The predictably fragmenting projectile of claim 8, wherein the first material comprises a copper alloy.

13. The predictably fragmenting projectile of claim 8, wherein the predictably fragmenting projectile is formed from a single piece of a copper alloy.

14. A predictably fragmenting projectile having a leading edge, a base, and internally-arranged geometric features, the predictably fragmenting projectile comprising:

a substantially solid core of a first material, the core comprising the base;

a substantially smooth ogive, the ogive comprising the leading edge;

a cavity comprising a first portion and a second portion, the first portion comprising a round void and the second portion comprising a polygonal void, wherein the first portion extends between a first level and a second level, and wherein the second portion extends from the second level to the leading edge; and a plurality of petals attached to the core and formed from the first material, each of the plurality of petals comprising an outer surface that comprises a portion of the ogive and an inner surface that forms part of the cavity, wherein the predictably fragmenting projectile is configured to deform by at least one petal of the plurality of petals pivoting outwardly away from the cavity in response to dynamic pressure created by a second material entering the cavity.

15. The predictably fragmenting projectile of claim 14, wherein the at least one petal of the plurality of petals is formed by break lines on an inside surface of the plurality of petals.

16. The predictably fragmenting projectile of claim 15, wherein the break lines correspond to corners formed by the polygonal void.

17. The predictably fragmenting projectile of claim 15, wherein the break lines are formed by a polygonal broach that is partially inserted into a hole that comprises the first portion.

18. The predictably fragmenting projectile of claim 14, wherein the first material comprises a copper alloy.

19. The predictably fragmenting projectile of claim 14, wherein the predictably fragmenting projectile is formed from a single piece of a copper alloy.

20. The predictably fragmenting projectile of claim 14, wherein the core comprises a frustum that comprises the base.

* * * * *